US010967247B1

(12) United States Patent
Henning et al.

(10) Patent No.: US 10,967,247 B1
(45) Date of Patent: Apr. 6, 2021

(54) GAME UTILIZING MAGNETIC FORCES

(71) Applicant: Kluster LLC, Bexley, OH (US)

(72) Inventors: Robert Lee Henning, Oceanside, CA (US); Paula L. Henning, Oceanside, CA (US); Charles Elliot Flower, Bexley, OH (US); John W. Herrmann, San Diego, CA (US)

(73) Assignee: Kluster LLC, Bexley, OH (US)

( * ) Notice: Subject to any disclaimer, the term of this patent is extended or adjusted under 35 U.S.C. 154(b) by 0 days.

(21) Appl. No.: 16/265,771

(22) Filed: Feb. 1, 2019

(51) Int. Cl.
*A63F 9/34* (2006.01)
*A63F 3/00* (2006.01)

(52) U.S. Cl.
CPC ..... *A63F 3/00694* (2013.01); *A63F 3/00697* (2013.01); *A63F 9/34* (2013.01); *A63F 2003/00738* (2013.01)

(58) Field of Classification Search
CPC ..... A63F 3/00694; A63F 2003/00738; A63F 9/34
USPC ..... 273/239, 443
See application file for complete search history.

(56) References Cited

U.S. PATENT DOCUMENTS 3,406,972 A 10/1968 Wong
5,031,907 A 7/1991 Warehime
5,421,581 A 6/1995 Smith
5,452,902 A * 9/1995 Foster ..... A63B 67/002 273/342
2008/0303208 A1 12/2008 Ozipko

OTHER PUBLICATIONS

Yikerz!(TM) Magnetic Board Game, http://yikerzgame.com/, website archived Jul. 31, 2012, with Instruction Manual copyright 2011 (Year: 2012).*
Knot & Rope Supply, http://www.knotandrope.com/Store/pc/home.asp, website archived Jan. 14, 2016 (Year: 2016).*
AttrAction Magnetic Game, https://boardgamegeek.com/image/2768395/attraction, posted online Nov. 23, 2015 (Year: 2015).*
Jishaku Magnetic Board Game, https://www.vat19.com/item/jishaku-magnetic-board-game/, website archived Jun. 17, 2014 (Year: 2014).*
String Savanna Rulebook by OZAKU brand, uploaded to boardgamegeek.com/filepage/90221/rules-english-pdf on Apr. 23, 2013 (Year: 2013).*
Action Attraction by TOMY, published in 1995, described at boardgamegeek.com/boardgame/16799/action-attraction, image of vintage box with rules obtained at picclick.co.uk/Vintage-Action-Attraction-Tomy-Boxed-Complete-Tactical-324249468357.html (Year: 1995).*
Jishaku: The Game of Magnetic Action by RSV Productions, Inc., Instructions, copyright 2007, available online at images.vatl9.com/manuals/jishaku.pdf (Year: 2007).*

(Continued)

*Primary Examiner* — Laura Davison
(74) *Attorney, Agent, or Firm* — Law Office of J. L. Simunic; Joan Simunic

(57) ABSTRACT

The present invention is a game that relies on the interactions of magnetic fields to test the skills of a player or players, and more specifically a game device which relies upon the characteristic of magnets in which like poles between two magnets form a mutual field of repulsion whereas opposing poles of the same magnets form a field of attraction.

9 Claims, 4 Drawing Sheets

(56) References Cited

OTHER PUBLICATIONS

MagnetX by PsyX Games, published 2007, described at boardgamegeek.com/boardgame/34859/magnetx (Year: 2007).*
Magnets the Game, designed by Jeff Lyon and Isaac Zaal, published 2014, described at boardgamegeek.com/boardgame/160891/magnets-game (Year: 2014).*
Polarity, designed by Douglas Seaton, published 1986, described at boardgamegeek.com/boardgame/380/polarity (Year: 1986).*
String Railway Playing Manual by OKAZU Brand, uploaded to https://boardgamegeek.com/filepage/58911/string-railway-english-rule on Oct. 1, 2010 (Year: 2010).*
String Railway image of game setup, uploaded to https://www.boardgamegeek.com/image/2014785/string-railway by Alex Singh on May 8, 2014 (Year: 2014).*

* cited by examiner

30

GAME UTILIZING MAGNETIC FORCES

CROSS-REFERENCE TO PRIOR APPLICATIONS

The present application does not claim priority to any previously filed patent applications.

FIELD OF THE INVENTION

The invention relates to games and apparati which are used as a medium for competitive amusement in the field of board and table games.

BACKGROUND OF THE INVENTION

There are a wide variety of board games and electronic interactive games commercially available. Some of these games require large or fixed systems, such as computer games that connect to television displays. Other games, such as most board games, are more mobile. Some games are designed just to provide a source of entertainment, whereas others are designed to provide valuable learning opportunities, such as role playing, reading, memory stimulation, tactile coordination, and the like. Whatever the format of the game, most games provide the opportunity to interact with other game participants and to have fun. Thus, there is always a demand for more exciting and entertaining games, and particularly for games that challenge the skills of the participants.

SUMMARY OF THE PRESENT INVENTION

The present invention is a game that relies on the interactions between magnets and their associated magnetic fields to test the skills of a player or players, and more specifically a game device which relies upon the characteristic of a magnetic field whereby magnetic poles attract or repel previously played magnets thereby altering the physical location of magnets in play.

BRIEF DESCRIPTION OF THE FIGURES

FIGS. 3A-3E are views of the playing space during play of the game, wherein FIG. 3A shows the designation of the playing space with the cord creating a periphery, FIG. 3B shows placement of first magnet, FIG. 3C shows placement of a second magnet, FIG. 3D shows magnet positions after six magnets have been played, and FIG. 3E shows the formation of a magnet cluster;

DETAILED DESCRIPTION OF THE PRESENT DEVELOPMENT

The following description is intended to provide the reader with a better understanding of the invention. The description is not intended to be limiting with respect to any element not otherwise limited within the claims.

Figure 1:
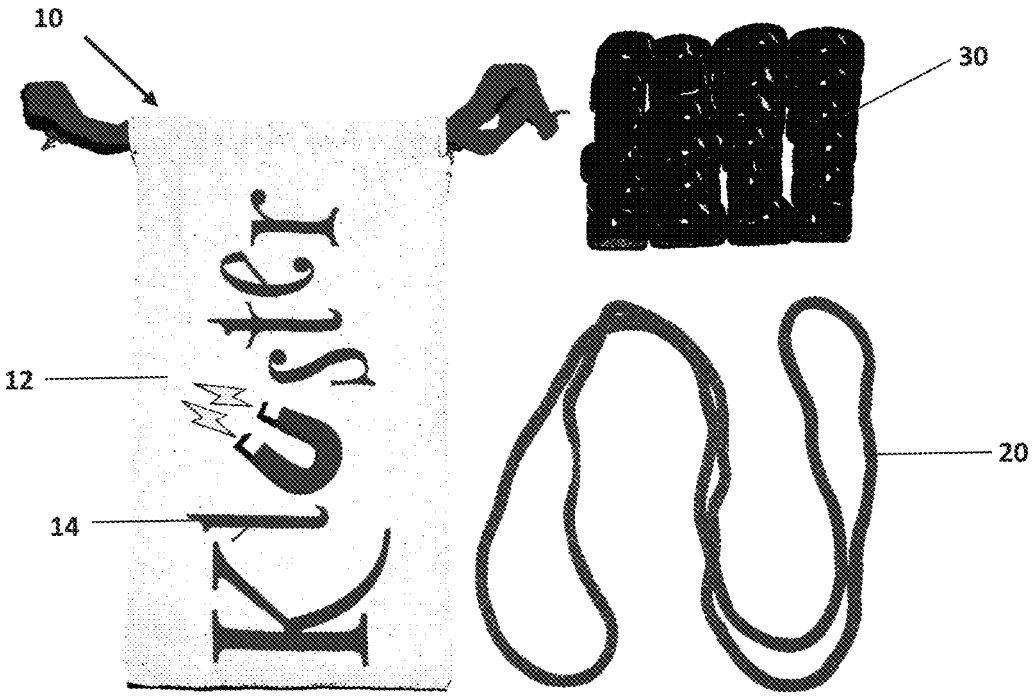
FIG. 1 is a top view of the cord and magnets of the present invention, and including an optional carrying pouch.

The present development is a game that relies on the interactions of magnetic fields to test the skills of a player or players, and more specifically a game device which relies upon the characteristics of a magnetic field whereby magnets of like or opposite poles form a mutual field of repulsion or attraction, respectively. As shown in FIG. 1, the magnet game 10 of the present invention comprises a cord 20 and a plurality of magnets 30. Optionally, a bag or pouch 12 may be included to transport and store the cord 20 and magnets 30. Optionally, indicia 14, such as a game name or game instructions (not shown), may be printed on the pouch 12.

Figure 2:
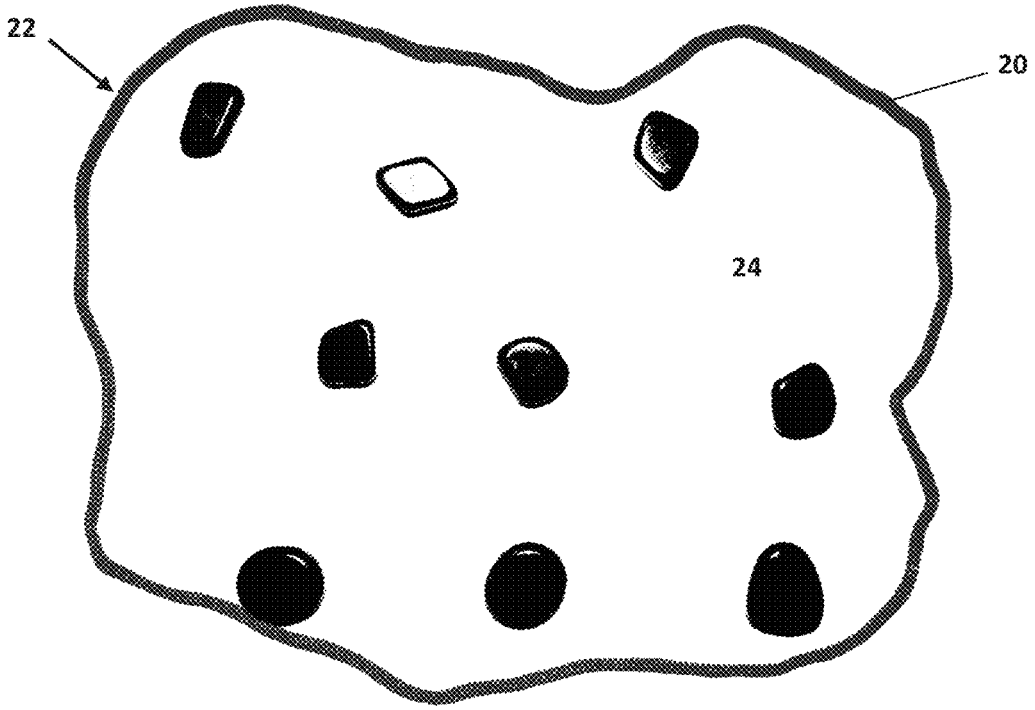
FIG. 2 is a top view of the present invention showing the cord and a representative set of magnets from FIG. 1 in position during the course of play.
Figure 2A:
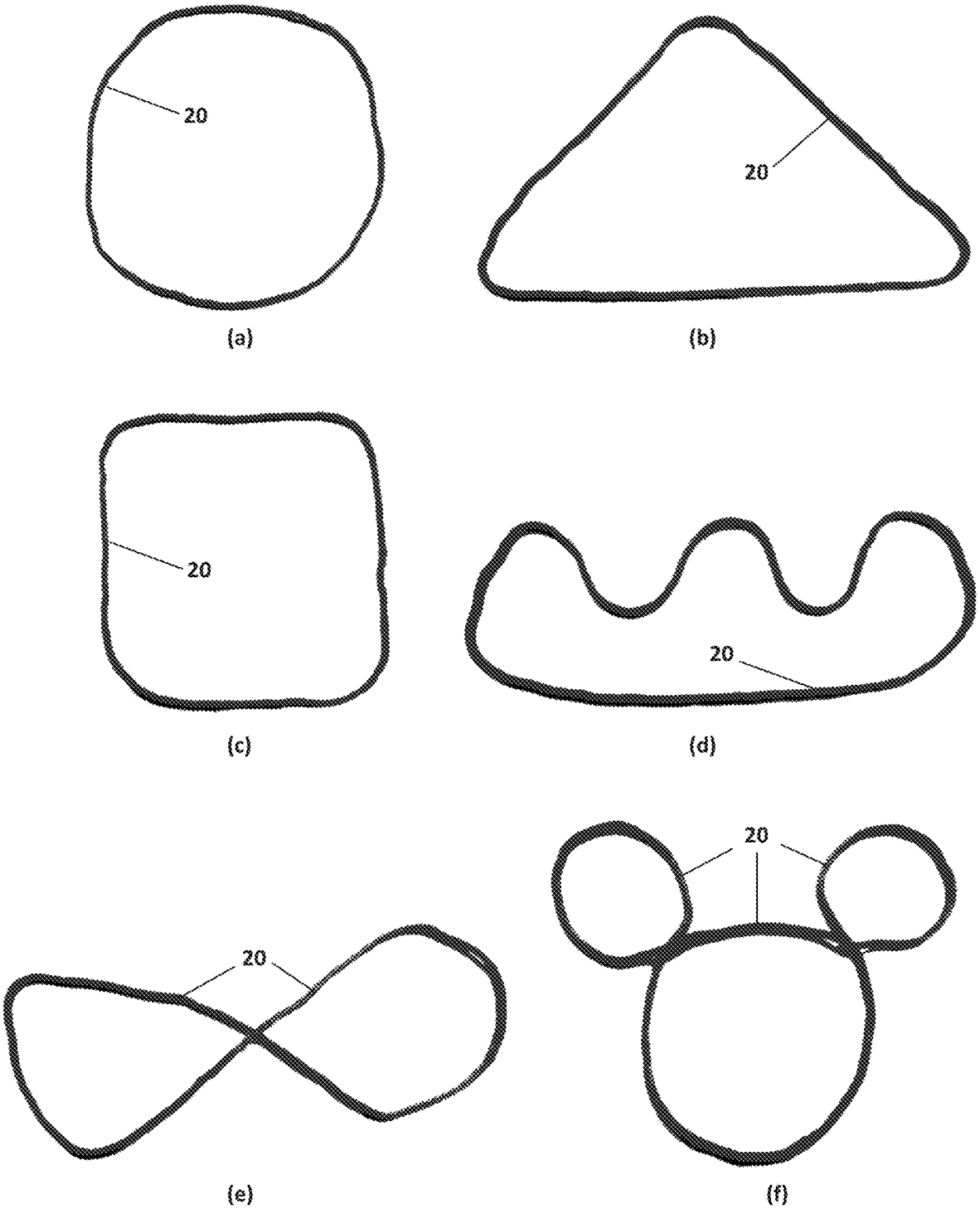
FIG. 2A shows the cord of the present invention in a plurality of example configurations for game play.

As shown in FIG. 2, the cord 20 is used to create a periphery 22 that defines a playing space 24. Examples of some possible layouts are shown in FIG. 2A, wherein the layouts shown in FIGS. 2A(e) and 2A(f) include nodes or points where the cord crosses over itself. The game is played by strategically placing the magnets 30 within the playing space 24. The objective of the game is for a player to strategically place all of the player's magnets 30 within the playing space 24 without causing magnets 30 already placed within the playing space 24 to be attracted to each other and to cluster.

Figure 3A:
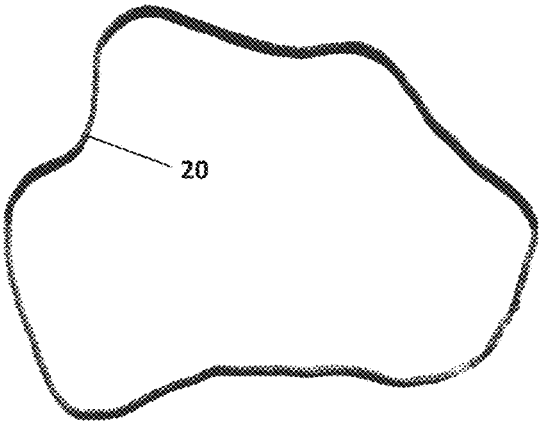
Figure 3B:
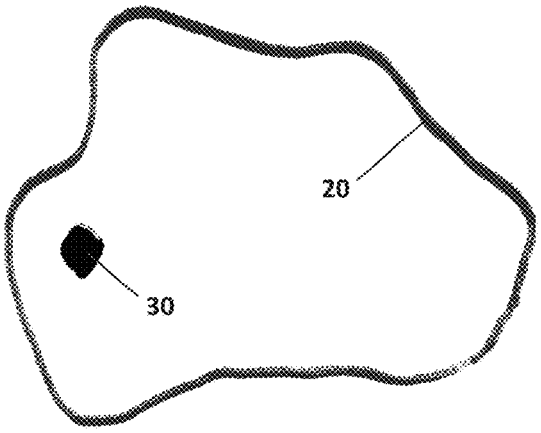
Figure 3C:
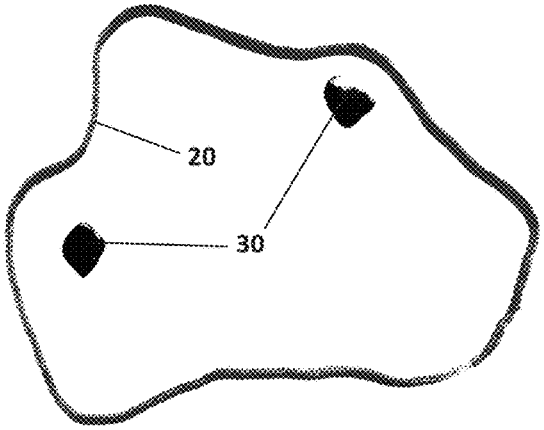
Figure 3D:
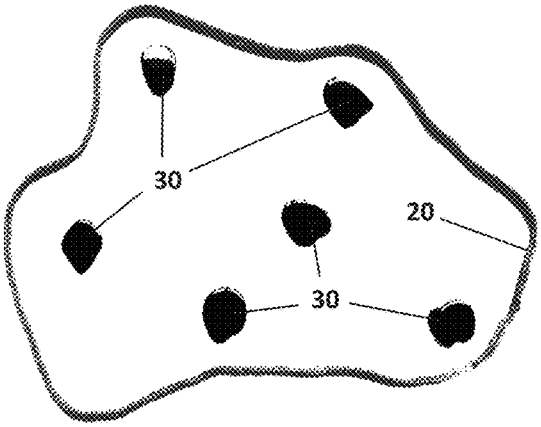
Figure 3E:
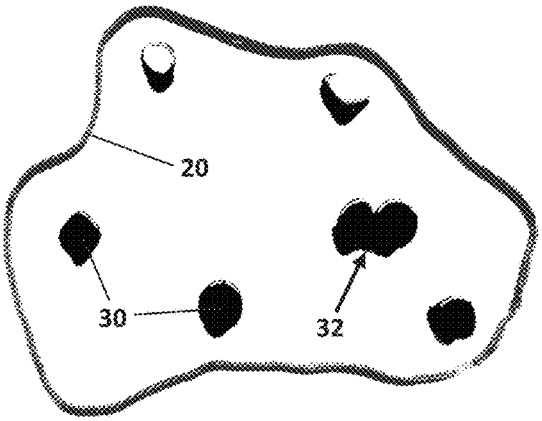

More specifically, the game is played by laying the cord 20 in any shape on a smooth or lightly textured, and relatively flat surface, as shown in FIG. 3A. The magnets 30 are divided among the total number of players such that each player receives the same number of magnets. For example, if there are twenty-four magnets provided for play and there are four players, each player would receive six magnets; whereas if there are twenty-four magnets and five players, each player would receive four magnets and four magnets may be set aside and out of play or the four magnets—or up to four magnets—may be placed within the playing space 24 such that the magnets are separated from each other before the first player's turn. One of the players is designated as a first player. As shown in FIG. 3B, the first player sets one of his or her magnets 30 at any location within the playing space 24. As shown in FIG. 3C, a second player then sets one of his or her magnets 30 at any location within the playing space 24, separate from the first magnet played. As long as the magnets 30 remain separated within the playing space 24 as shown in FIG. 3D, play continues, with each consecutive player placing magnets 30 within the playing space 24. If the magnets 30 are attracted to each other and create a cluster or "Kluster" 32, as shown in FIG. 3E, the player who created the Kluster 32 must remove all the joined magnets 30 from the playing space 24 and that player keeps the magnets 30 that formed the Kluster 32. The game continues until one player successfully places all of his or her magnets 30 within the playing space 24 without creating the Kluster 32. On his or her turn, a player may use the inherent forces of the magnet being played to rearrange magnets 30 already in the playing space 24, or to rearrange the cord 20 thereby changing the playing space periphery 22, but if any other magnets 30 form the Kluster 32 while being rearranged, the player who caused the Kluster 32 must collect the clustered magnets 30. During play, players may not touch the cord 20 or any magnets 30 that have already been played in the playing space 24—any rearrangements must be accomplished merely using magnetic forces.

The cord 20 is comprised of any flexible material that can be used to define the periphery 22. Exemplary materials are twine, manila rope, cotton rope, polypropylene rope, nylon rope, polyester rope, polyethylene rope, Kevlar rope, cotton thread, silk thread, nylon thread, hemp thread, or a combination thereof, and may be formed as a twisted rope, solid braid, hollow braid, double braid, diamond braid, or a combination thereof. However, any flexible material that can be formed into a shape to create a periphery that defines a playing space may be used.

The cord 20 must be long enough to create a playing space 24 that will allow for each player to place at least one magnet 30 within the playing space 24. In a preferred embodiment, the cord 20 is a closed loop, that is, there is no open end. In an alternative embodiment, the cord 20 is a rope with a first end and a second end wherein the first end and second end are used to form a closed loop, such as by tying the ends together or by using a slip knot or by using a cord lock, as is known in the art. In a first embodiment, the cord is a closed loop long enough to create a periphery of at least 85 cm. In a second embodiment, the cord is a rope with a first end and a second end, wherein the ends of the rope are secured by a cord lock and wherein the cord lock position can be adjusted to vary the measurement of the periphery.

Figure 4:
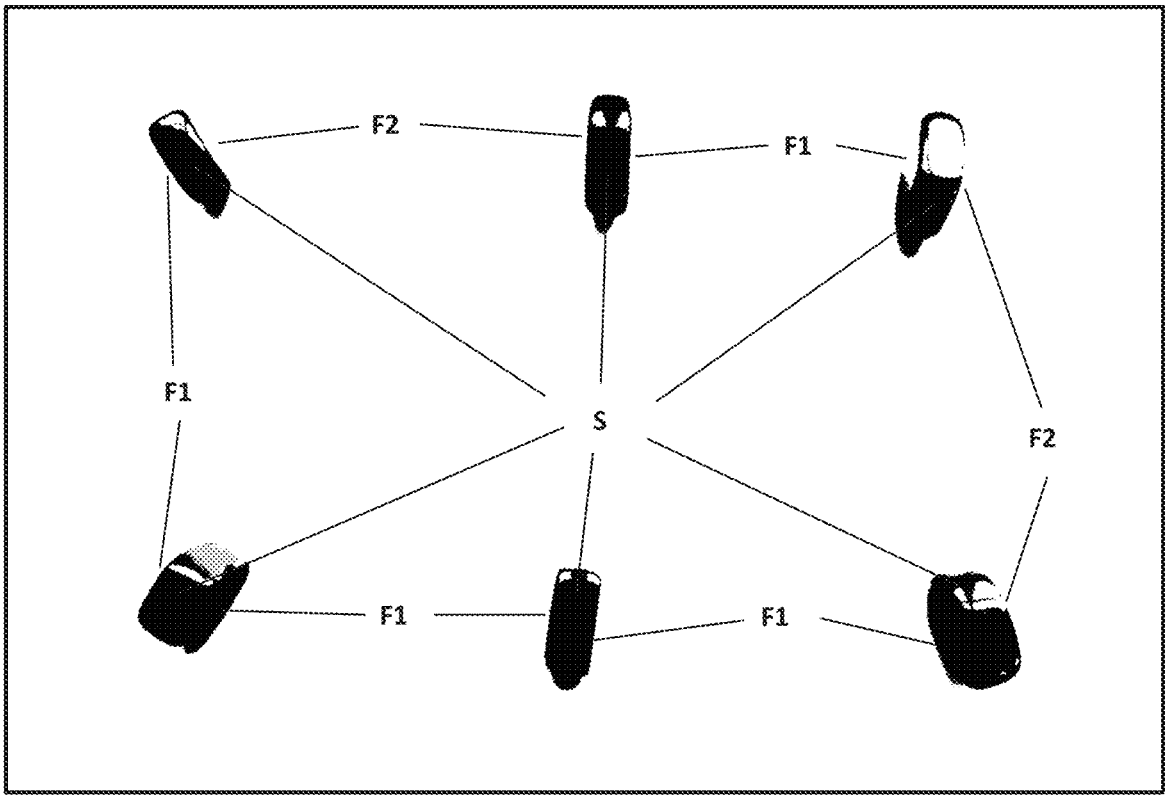
FIG. 4 is an image showing the side views of six representative magnets; and, FIG. 5 is an image showing the face views of the six representative magnets of FIG. 4.
Figure 5:
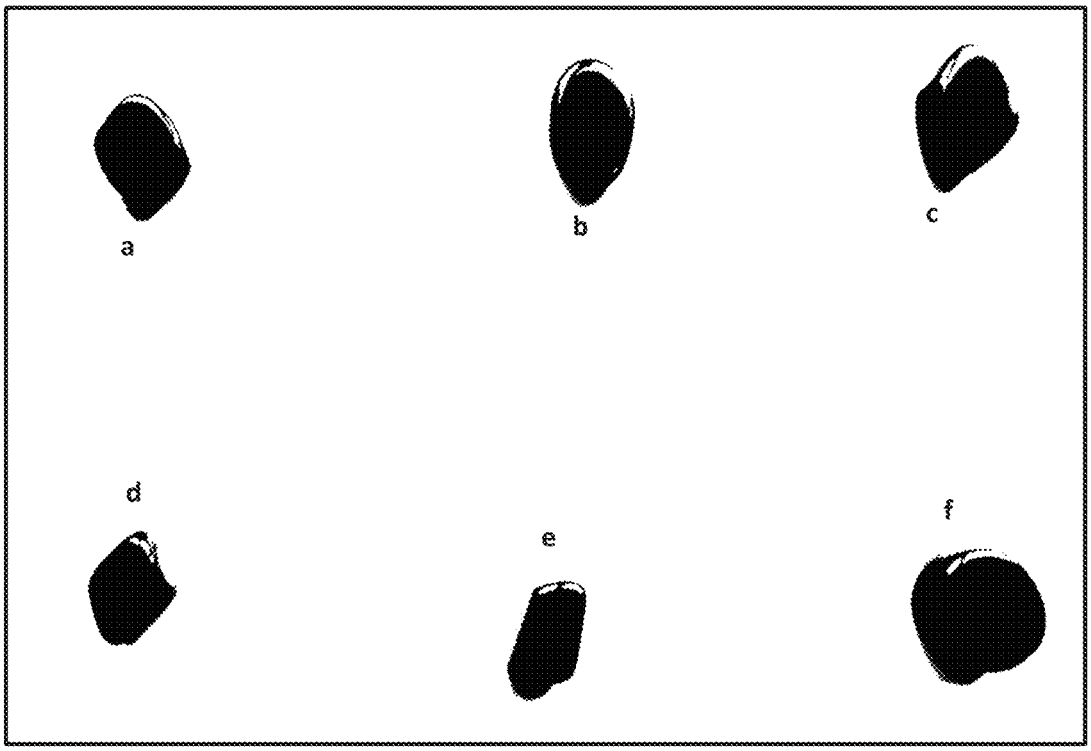

As shown in FIGS. 1-5, the magnets 30 can have a variety of sizes and shapes. As shown in FIG. 4, each magnet 30 defines a first face F1, a second face F2 and a sidewall S. In a preferred embodiment, the first face F1 and the second face F2 for any particular magnet 30 have essentially the same configuration, and define the "shape" of that particular magnet 30. For example, as shown in FIG. 5, the shape may be generally circular (5*f*) or oval (5*b*) or diamond-shaped (5*d*) or rectangular (5*e*) or irregular (5*a* and 5*c*). Optionally, the magnets 30 may be polished and may have rounded edges where the faces F1, F2, meet the sidewall S.

The first face F1 further defines a facial surface area for each magnet 30. The facial surface area for any magnet 30 is preferably greater than about 1.5 $cm^2$, and more preferably greater than about 2 $cm^2$. Further, the facial surface area for any magnet 30 is preferably less than about 6 $cm^2$, and more preferably less than about 5 $cm^2$. The sidewall S defines a depth D of each magnet 30. The depth D is preferably from about 0.8 cm to about 1.3 cm, and more preferably from about 0.9 cm to about 1.1 cm.

Although the description above contains many specifications, these should not be construed as limiting the scope of the invention, but as merely providing illustrations of some of the presently preferred embodiments of this invention. For example, the cord 20 may be lengthened to provide a larger playing space 24 or the cord 20 may be shortened to create a small playing space 24. Thus the scope of the invention should be determined by the appended claims and their legal equivalents, rather than by the examples given.

Unless defined otherwise, all technical and scientific terms used herein have the same meaning as commonly understood by one of ordinary skill in the art to which the presently disclosed subject matter pertains. The terms "a", "an", and "the" refer to "one or more" when used in the subject specification, including the claims.

Unless otherwise indicated, all numbers expressing quantities of components, measurements, and otherwise used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter. As used herein, the term "about", when referring to a value or to measurement can encompass variations of, in some embodiments ±20%, in some embodiments ±10%, in some embodiments ±5%, in some embodiments ±1%, in some embodiments ±0.5%, and in some embodiments to ±0.1%, from the specified amount, as such variations are appropriate in the disclosed application.

It is understood that, in light of a reading of the foregoing description, one with ordinary skill in the art may make alterations and/or modifications to the present invention, and specifically to the embodiments shown and described herein, without departing from the scope of the invention.

What is claimed is:

1. A method of playing a game utilizing magnetic forces comprising the steps:

(a) assembling a plurality of players, wherein the players are designated by ordinal numbers starting with a first player and a second player until all players are numbered;

(b) obtaining a flexible cord, wherein the cord is a closed loop;

(c) obtaining a plurality of magnets, wherein each magnet defines a first face, a second face and a sidewall, and wherein the first face defines a facial surface area and the facial surface area is greater than about 1.5 $cm^2$ and less than about 6 $cm^2$, and wherein the sidewall defines a depth of the magnet and the depth is from about 0.8 cm to about 1.3 cm;

(d) laying the cord in any shape on a relatively flat smooth or lightly textured surface such that the cord defines a perimeter and the area within the perimeter of the cord creates a playing space;

(e) distributing the magnets among the total number of players such that each player receives the same number of magnets;

(f) having the first player set one of his or her magnets at any location within the playing space and designating the placed magnet as a played magnet;

(g) having each player in sequential order then play one of his or her magnets by using the inherent repulsion forces of the magnet being played to move played magnets already in the playing space, wherein at least one player uses the inherent repulsion forces of the magnet being played to move played magnets already in the playing space so as to rearrange the cord and change the shape of the playing space, and then setting the player's magnet at any location within the rearranged playing space and separate from the played magnets without the player directly touching the cord or any played magnets;

(h) having the players in sequential order continue to place magnets within the playing space until one or more magnets that are within the playing space are attracted to the magnet being played and form a cluster;

(i) having the player who created the cluster remove all the joined magnets from the playing space and having that player keep the magnets that formed the cluster;

(j) continuing game play until one player successfully places all of his or her magnets within the playing space without creating the cluster.

2. The method of claim 1 wherein the cord comprises twine, manila rope, cotton rope, polypropylene rope, nylon rope, polyester rope, polyethylene rope, Kevlar rope, cotton thread, silk thread, nylon thread, hemp thread, or a combination thereof.

3. The method of claim 1 wherein the cord is a rope with a first end and a second end wherein the first end and second end are used to form the closed loop.

4. The method of claim 1 wherein the cord is used to create a playing space having a periphery of at least 85 cm.

5. The method of claim 1 wherein the first face of each magnet defines a shape and wherein the shape is circular or oval or diamond-shaped or rectangular or irregular.

6. The method of claim 1 wherein the facial surface area is greater than about 2 $cm^2$ and less than about 5 $cm^2$.

7. The method of claim 1 wherein any magnets not distributed to players are set aside and out of play.

8. The method of claim 1 wherein at least one magnet not distributed to players is placed within the playing space before the first player's turn.

9. The method of claim 1 wherein at least two magnets not distributed to players are placed within the playing space before the first player's turn such that the magnets are separated from each other.

* * * * *